United States Patent [19]

Buxton

[11] 3,987,884

[45] Oct. 26, 1976

[54] PRINTING APPARATUS WITH PAPER POSITIONING TRACTOR MEANS AND ESCAPEMENT MEANS

[75] Inventor: Edward J. Buxton, Summit, N.J.

[73] Assignees: Edward J. Buxton, Summit, N.J.; Albert C. Nolte, jr., Oyster Bay, N.Y.; Walter Hladky, Chatham, N.J. ; part interest to each

[22] Filed: June 9, 1972

[21] Appl. No.: 261,452

Related U.S. Application Data

[63] Continuation of Ser. No. 56,239, July 16, 1970, abandoned, which is a continuation of Ser. No. 845,602, June 30, 1969, abandoned, which is a continuation of Ser. No. 683,032, Nov. 14, 1967, abandoned, which is a continuation of Ser. No. 484,514, Sept. 25, 1965, abandoned.

[52] U.S. Cl. ..... 197/49; 197/133 R; 101/93.19; 226/49; 226/74; 226/158; 178/32

[51] Int. Cl.[2] ..... B41J 1/32; B41J 15/00

[58] Field of Search ..... 101/93 C, 93.19; 197/133, 51, 49, 20; 178/32, 34, 38, 28; 226/74, 75, 49, 158

[56] References Cited

UNITED STATES PATENTS

| | | | |
|---|---|---|---|
| 2,543,919 | 3/1951 | Mabon et al. | 197/133 R |
| 3,114,491 | 12/1963 | Wright | 197/133 R X |
| 3,154,235 | 10/1964 | Hubbard | 197/133 R X |
| 3,168,182 | 2/1965 | Bernard et al. | 197/18 X |
| 3,232,404 | 2/1966 | Jones, Jr. | 101/93 C X |
| 3,313,390 | 4/1967 | Curtiss | 197/133 R |
| 3,334,722 | 8/1967 | Bernard | 197/133 R |

*Primary Examiner*—E. H. Eickholt
*Attorney, Agent, or Firm*—Nolte and Nolte

[57] ABSTRACT

The invention is directed to a highspeed digital print-out apparatus. The apparatus involved is provided with tractors which move the paper in a first direction past a stationary print-out wheel which in conjunction with a print hammer imprints preselected indicia upon the paper. The paper is movable in the reverse or third direction, again by the tractors, to initiate a new line of indicia and in a second direction normal to said forward and reverse directions to provide spacing between adjacent lines. There is also provided a reversing mechanism for moving the paper in a fourth direction reverse to the second direction to position the paper for the start of a new sheet.

21 Claims, 19 Drawing Figures

INVENTOR
EDWARD J. BUXTON
BY
Nolte & Nolte
ATTORNEYS

INVENTOR
EDWARD J. BUXTON
BY
Nolte & Nolte
ATTORNEYS

INVENTOR
EDWARD J. BUXTON
BY Nolte & Nolte
ATTORNEYS

INVENTOR
EDWARD J. BUXTON
BY
Nolte & Nolte
ATTORNEYS

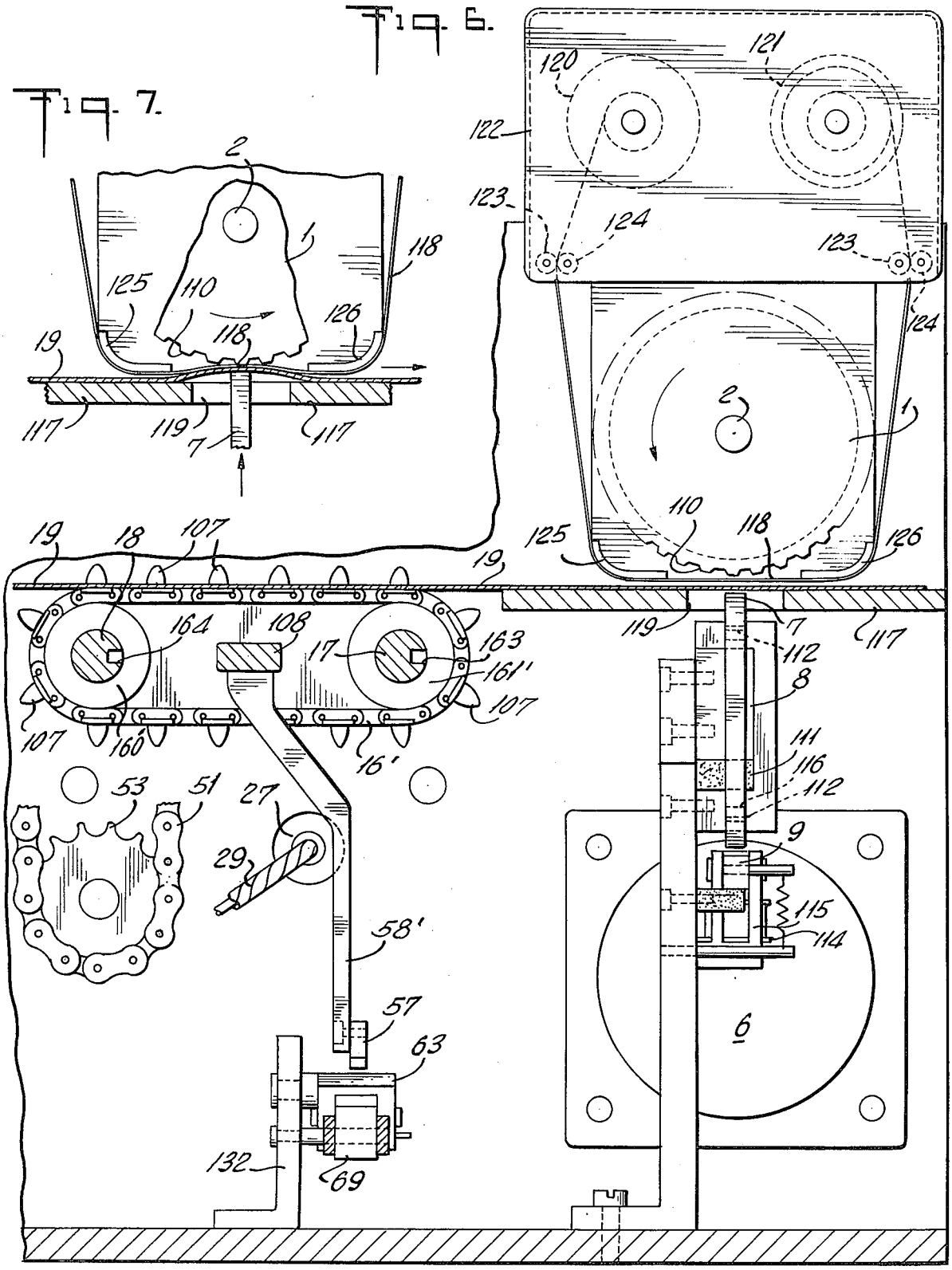
INVENTOR
EDWARD J. BUXTON
BY Nolte & Nolte
ATTORNEYS

INVENTOR
EDWARD J. BUXTON
BY
Nolte & Nolte
ATTORNEYS

INVENTOR
EDWARD J. BUXTON
BY Nolte & Nolte
ATTORNEYS

INVENTOR
EDWARD J. BUXTON
BY Nolte & Nolte
ATTORNEYS

INVENTOR
EDWARD J. BUXTON
BY
Nolte & Nolte
ATTORNEYS

INVENTOR
EDWARD J. BUXTON
BY Nolte & Nolte
ATTORNEYS

PRINTING APPARATUS WITH PAPER POSITIONING TRACTOR MEANS AND ESCAPEMENT MEANS

This application is a continuation of application Ser. No. 56,239 filed July 16, 1970 (now abandoned), which is a continuation of application Ser. No. 845,602 filed June 30, 1969, (now abandoned), which is a continuation of application Ser. No. 683,032 filed Nov. 14, 1967 (now abandoned), which is a continuation of application Ser. No. 484,514 filed Sept. 25, 1965 (now abandoned).

This invention relates to a high speed printer capable of printing out a plurality of characters in response to a digital code.

More particularly this invention relates to a high speed digital print out apparatus for printing a plurality of characters or messages onto a paper record which is selectively orientated by a carriage beneath a print-out wheel containing the characters for imprinting the characters longitudinally along the paper.

Coded data systems are presently in wide use for the transmission of information over long lines, circuits or channels and wherein these circuits terminate in printers, data processors, or other information manifesting apparatus used to interconnect computer systems. The adoption of "machine language" codes such as digital or binary codes yields advantages over oral or other human transmission including the more efficient use of bandwith and other capabilities, relative ease of error detection and correction as well as efficient and high speed transmission. The present day printers employed to convert digital or binary information into printed information suffer from the disadvantages that they are highly complex and expensive to manufacture, maintain and operate. In some print out apparatus, it is known to employ indicia coupled to a magnetic coil and operated by individually actuating each of the indicia by means of a magnetic coil or solenoid so as to transfer the digit onto a paper or recording thereof. Many of these apparatus require dusting boxes to which a magnetic ink is provided to contact with the recording drum so as to highlight digits that are magnetically recorded onto the drum. A paper is then impressed against the drum and in contact with the magnetic ink to print out the recorded digits. These magnetic printers usually suffer from the disadvantages that they are complex in design, costly to maintain and are limited in speed by the response of the magnetized digits and the recording drum.

In other known high speed printing apparatus a paper tape is moved past a single line of letters whereby the characters are generally arranged longitudinally in the direction of the paper tape and are selectively actuated to print in the paper location on the paper tape as the tape moves beneath the characters. The above known high speed printing apparatus suffer from the disadvantages that the indicia and the paper must usually be monentarily stopped while the printing operation takes place. Therefore, the response of the printer is usually limited by the speed of response of the characters or the indicia which must do the printing.

Moreover attempts to improve the speed of printers by increasing the number of characters available for printing have merely resulted in providing a machine which is unduly complex and expensive to operate and maintain.

Accordingly, the present invention relates to a high speed digital communications printer which may operate off telephone or telegraph lines at a remote station. The printer is capable of printing out the complete alphabet plus all of the numerals, as well as thirteen symbols. The apparatus is capable of printing up to 32 characters per second and may be adapted to print up to 150 characters for each line. One form of the printer may print up to 30 lines of print on a single page. The printer employs approximately one-fifth the mechanical parts used by other available printing devices for producing the same result. The reduction in parts of the printer has resulted in reduced wear and a minimum amount of maintenance required to service the printer.

The printer, according to the invention, employs a single character wheel, pivotably mounted within the chassis of the recorder and driven by a continuously operating motor. The character wheel contains a plurality of indicia located along its periphery, which continuously rotate in close proximity to a record medium or page to be printed. The printed page is held in place beneath the continuously rotating character wheel by means of a track mechanism or paper tractor mounted on a sliding carriage for positioning the paper beneath the character wheel while the paper is printed. The track mechanism consists of a pair of endless belts coupled to each other and spaced apart by the width of the paper form. The belts contain a plurality of sprocket pins evenly spaced along their periphery for engaging corresponding sprocket holes located along the longitudinal edges of the record medium or paper forms to be printed. The belts are supported within the printing apparatus by means of a pair of spaced-apart tractor drive shafts which drive the paper tractor forward along the line of the characters being printed out. The tractor drive shafts which contain a keyway along their length, permit the tractor to slide transversely with respect to the line of type being printed so that additional lines of type may be added to the paper form.

In the actual printing operation the paper form may be positioned so that the first line of print will be typed in an area defining the upper left-hand corner of the page. A coded message representing one of the characters to be printed, is fed into the printing apparatus. By suitable circuity, when the indicia selected has moved on the continuously rotating character wheel to a position in close proximity to the paper form, a hammer momentarily strikes that portion of the paper immediately below the indicia against the moving indicia to cause the indicia to be printed on to the page. The paper form is subsequently advanced in the direction of travel of the indicia by an incremental feed mechanism coupled to the paper tractor controlling the paper form. A suitable ink or typewriter ribbon may be deployed in the space between the paper and the character wheel to permit the indicia to be typed on to the page. As the coded messages are fed to the machine representing each of the indicia to be printed, suitable electronic circuity determines when the preselected indicia have moved on the rotating character wheel to a position immediately adjacent to the paper to thereby actuate a hammer to strike the paper against the desired indicia whilst simultaneously advancing the paper to the next space. When the end of a line of type has been printed, the paper track mechanism quickly rotates the paper back to the original margin and simultaneously shifts the track along the keyway of the tractor drive shafts a space of one line so as to position the paper for the second line of printing.

When the last of a plurality of lines has been printed on the paper form, and the last indicia has been struck, the track mechanism automatically advances the paper so as to move a new paper form in position below the character wheel and simultaneously move the paper tractor containing the paper transversely to the direction of travel of the printed line, in order to shift the paper in position for the printing of a new line of type. Since the paper is struck against the character wheel during the printing of each character, it is also possible to employ paper forms having a plurality of carbon copies to enable the production of duplicate copies to be made during the print-out process.

Accordingly, it is an object of the present invention to provide a high speed communication printer responsive to digital innformation for rapidly printing out a plurality of indicia on to a record medium which is continuously positioned to receive the data.

It is another object according to the present invention, to provide a high speed communication printer for printing out a plurality of information employing apparatus whose design is mechanically and electrically simple for long trouble free life, or relatively low cost, and requiring a minimum of power.

It is another object according to the invention, to provide a high speed communication printer capable of printing a plurality of indicia on to a record medium employing a single continuously rotating character wheel and a track mechanism mounted on a sliding carriage for selectively positioning the record medium in communication with the character wheel to facilitate the rapid printing of a plurality of data.

It is another object according to the invention to provide a high speed print-out apparatus responsive to a digital code from a telephone or telegraph line for providing a plurality of data to be printed on a record medium, both efficiently and rapidly.

Other objects and features of the present invention will become apparent from the following detailed description considered in connection with the accompanying drawings which enclose the embodiments of the present invention. It should be understood, however, that the drawings are designed for purposes of illustration only, and not as a definition of the limits of the invention, as to which reference should be made to the appended claims. In the drawings, wherein similar reference characters denote similar elements throughout the several views:

FIG. 6 is an enlarged fragmentary section along section 6—6 of FIG. 2;

FIG. 7 is a fragmentary view of a portion of FIG. 6 illustrating the apparatus in a print position;

Figure 1:
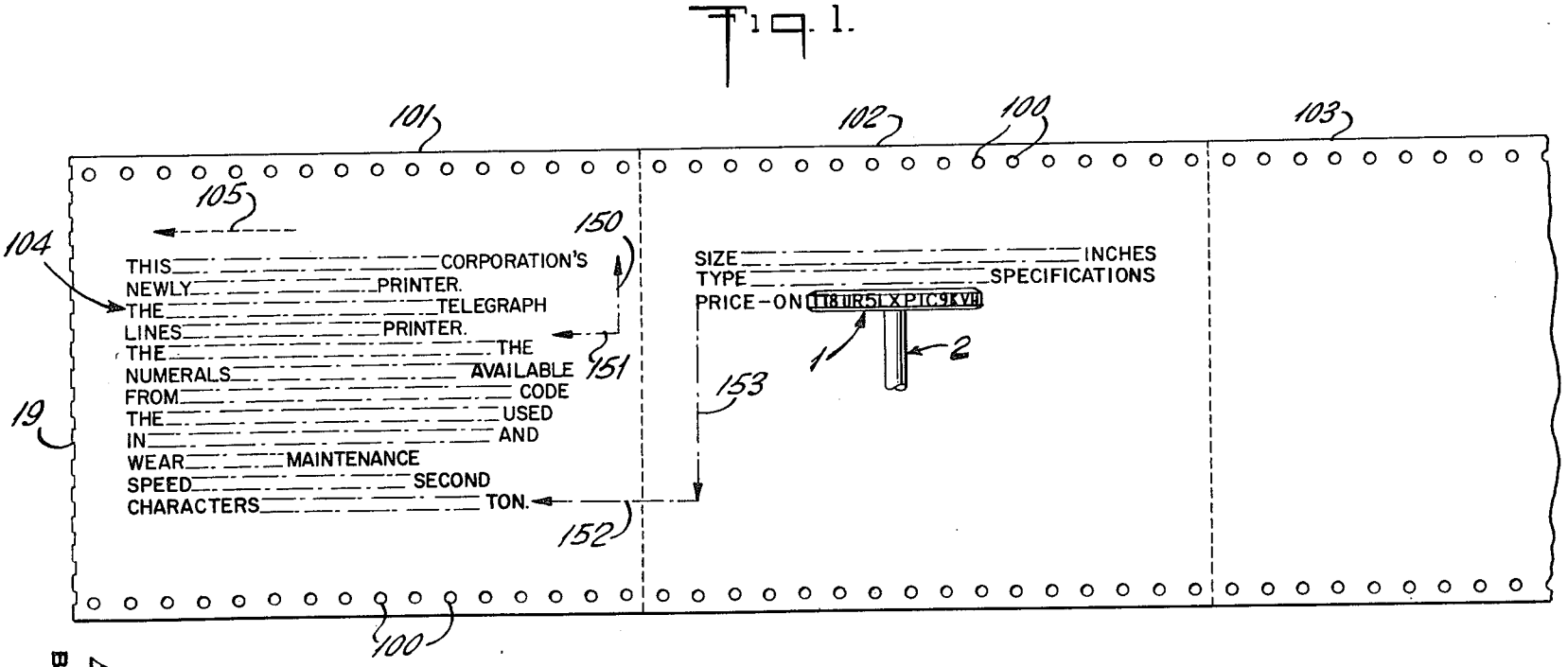
FIG. 1 is a schematic plan view of a printed sheet showing a first frame completely printed, a second frame partially printed, and a third frame ready to be printed.

FIG. 1 discloses a typical paper form comprised of a plurality of frames 101, 102 and 103, detachably mounted together and adapted to be fed into a sprocket type tracking mechanism of the printer according to the invention. The paper is illustrated having a frame 101, a number of lines of information already printed thereon, each beginning at a margin 104 and proceeding along the direction nof travel of the paper through the printer. Frame 102 is an illustration of a plurality printed frame showing a character wheel 1 having a plurality of indicia disposed along its periphery and continuously rotated around a fixed axis by shaft 2. Frame 103, detachably mounted to frame 102, is illustrated as the next frame to be printed after the completion of the printing of frame 102. Character wheel 1 rotates on a fixed axis defined by driving shaft 2 which is driven by a constant speed motor. The paper shown in part by frames 101, 102 and 103 is selectively and accurately positioned in close proximity to character wheel 1 for each of the digits to be printed out. The paper is held in place by means of a track mechanism to be described herein, which is capable of either incrementally or rapidly advancing the paper in a direction along its length or rapidly or incrementally shifting the paper transversely with respect to the character wheel so that the character wheel may be placed in communication with any portion of either of the frames for the purposes of printing the data thereon.

There are five distinct movements of the track mechanism for positioning the paper with respect to character wheel 1. In printing a page of type such as that shown in frame 101, the paper is initially positioned so that character wheel 1 is in close proximity with the first letter to be printed against margin 104. As each letter is being printed across the first line of type, the paper is incrementally stepped by an incremental feed mechanism in the direction shown by arrow 105 a distance of one character width. When the last letter of line 1 has been printed, the paper is shifted by an incremental shift mechanism along the direction illustrated by arrow 150. The paper is also simultaneously returned to margin 104 along the direction shown by arrow 151 by means of a quick feed return mechanism coupled to the track mechanism. When the last character of the last line has been printed of frame 101, a quick forward mechanism moves the paper, as shown by the direction of arrow 152, into the margin of frame 102. Simultaneously, a quick shift return mechanism shifts the paper transversely, as illustrated by the direction of arrow 153, so that the margin of the first line of frame 102 comes to rest in close proximity to character wheel 1.

The specific details of the apparatus according to the invention for providing each of the five movements of the paper as it is printed are described in detail herein with reference to the remaining figures.

Figure 2:
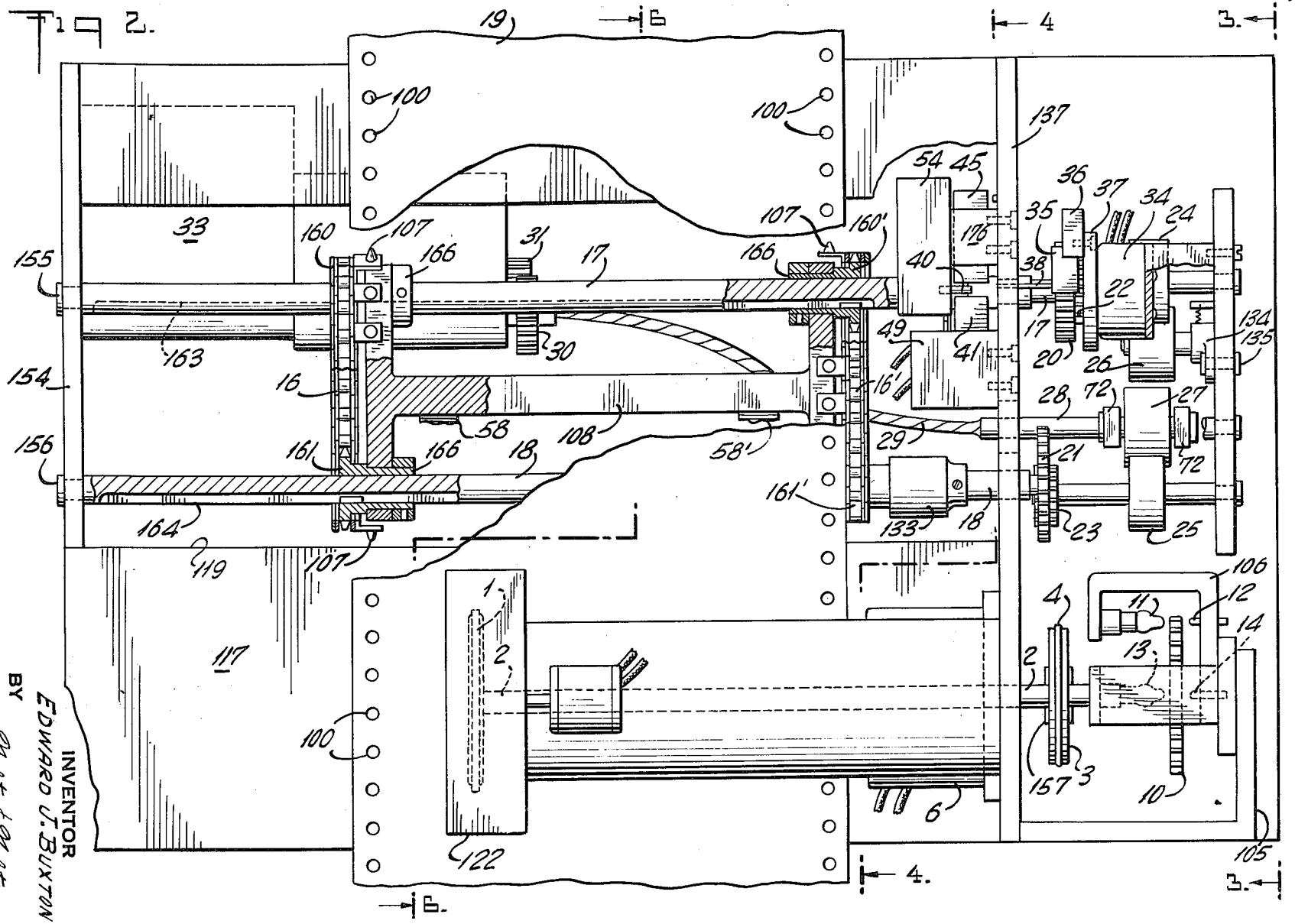
FIG. 2 is a plan view of the machine according to the invention with parts broken away and shown partially in section.

FIG. 2 is an illustration of the top view of the printer according to the invention, wherein a paper 19 containing a plurality of sprocket holes 100 along each edge and adapted to engage a sprocket type track mechanism suspended between two spaced apart shafts 17 and 18 pivotally mounted on one end of frame 154 and journals 155 and 156. The track contains a plurality of sprockets 107 adapted to move with the track and communicate with sprocket holes 100 to advance the paper during the printing process.

The track mechanism consists of a pair of spaced apart endless paper tractors 16 and 16' driven by tractor sprockets 160, 161, and 160' and 161'. The tractor sprockets are each keyed to a pair of spaced apart tractor drive shaft 17 and 18 which are pivotally journalled at one end in frame 154 at bearings 155 and 156. The opposite ends of shafts 17 and 18 are selectively coupled to various drive trains for advancing or returning the paper tractor. The track mechanism also includes a carriage 108 for maintaining and positioning the paper tractors a fixed distance apart. The four arms of carriage 108 are journaled to receive tractor sprockets 160, 161, 160' and 161'. End bushings 166 secured to an extended shaft of each of the sprockets maintains the sprockets pivotably mounted within the arms of carriage 108. Shafts 17 and 18 include keyways 163, 164 running along their length to permit the drive sprockets and thus carriage 108 to slide freely along the axis of the shafts while tractors 16, 16' are driven by the rotation of the shafts.

A continuously rotating character wheel 1 is shown located in close proximity to paper 19 and positioned over a portion of the paper adjacent to the tracking mechanism. Character wheel 1 includes a plurality of raised indicia or type spaced along its periphery. Wheel 1 is adapted to rotate on the end of shaft 2 journalled in the chassis of the printer. A constant speed motor 6 having a output pulley 157 drives belt 4 connected to pulley 3 and keyed to shaft 2 to provide rotation to wheel 1. The axial position of character wheel 1 remains fixed with respect to the chassis of the printer during its rotation around the axis of shaft 2. shaft 2 is also coupled to toothed gear 10 which serves as a photo-electric light chopper for generating character clock and index pulses.

Figure 18:
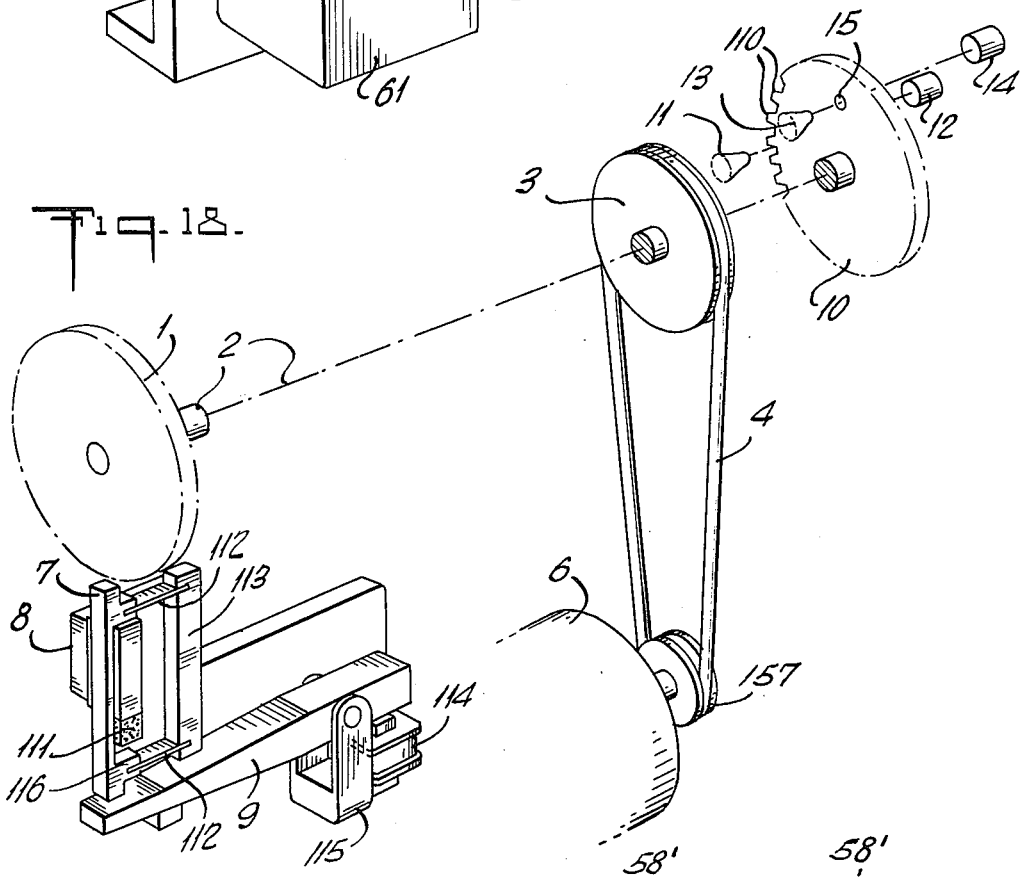
FIG. 18 is a front perspective view of the character wheel and print hammer apparatus according to the invention.

As shown in more detail in FIG. 18, a lamp 11 is directed to project through the teeth 110 along the periphery of wheel 10 so as to produce intermittent pulses of light upon photo-electric cell 12. Photo-electric cell 12 therefore produces a plurality of even spaced clock pulses proportional in frequency to the speed of motor 6 driving timing wheel 10. A second lamp 13 is positioned adjacent to wheel 10 to direct a beam of light through a hole 15 along the inner periphery of gear 10 for producing a single index pulse of light for each revolution of gear 10 and directing that beam onto photo-electric cell 14. Thus, the index pulse and the clock pulses provide a digital indication of the displacement of character wheel 1 and thus location of the characters with respect to the wheel. It is advantageous to have each of the clock pulses represent one of the characters on the character wheel. This operation is more fully described below in the discussion of FIG. 19.

The actual printing of the characters onto paper 19 is performed by means of a hammer actuator assembly which srikes the paper against the moving character wheel when a preselected indicia moves in close proximity to the paper. Referring to FIG. 18, the hammer actuator assembly consists of an actuator arm 9 pivoted on U-bolt mount 115 and responsive to the pull produced by solenoid 114. Actuation of solenoid 114 moves arm 9 in contact with print hammer 7 to cause hammer 7 to strike upward against character wheel 1 to cause paper 19 to momentarily contact one of the indicia of the character wheel to produce the printed read out on the moving paper. Print arm 7 is coupled to frame support 113 through a pair of supporting leaf springs 112 and maintain hammer arm 7 in a neutral position between the character wheel and the actuator arm. Arm 7 slides within a vertical support 8 containing a rubber bumper 111 which engages with L-shaped stop 116 protruding from hammer arm 7 to cushion the impact of the surface of hammer 7 against the character wheel 1.

FIG. 6 shows an end view of the hammer assembly mounted within the printer with respect to the paper feed mechanism. Paper tractor 16, containing sprocket pins 107, engages paper 19 and feeds it along surface 117 in close proximity to character wheel 1. Paper hammer 7 is adapted to pass through a slot 119 and strike one of indicia on character wheel 1. Intermediate the character wheel and the paper 19 is stretched a typewriter ribbon 118 coiled around spools 120 and 121 and contained in assembly 122. A pair of rollers 123 and 124 contained within assembly 122 aid in maintaining ribbon 118 in tension during the printing process. Rollers 120 and 121 may advance the typewritten ribbon one character space after each printing in a manner similar to that employed by conventional typewriters.

As shown in more detail in FIG. 7, typewirtten ribbon 118 is maintained in tension across a pair of guides 125 and 126 located on opposite sides of character wheel 1. At the moment when solenoid 114 of the hammer assembly has been actuated, print hammer 7 rises to strike against one of the desired indicia selected on character wheel 1. Hammer 7 immediately returns to its neutral position after momentarily striking paper 19 against character wheel 1. Paper 29 has also advanced to the next space ready for printing.

A. INCREMENTAL FEED OF PAPER TRACTOR

Figure 8:
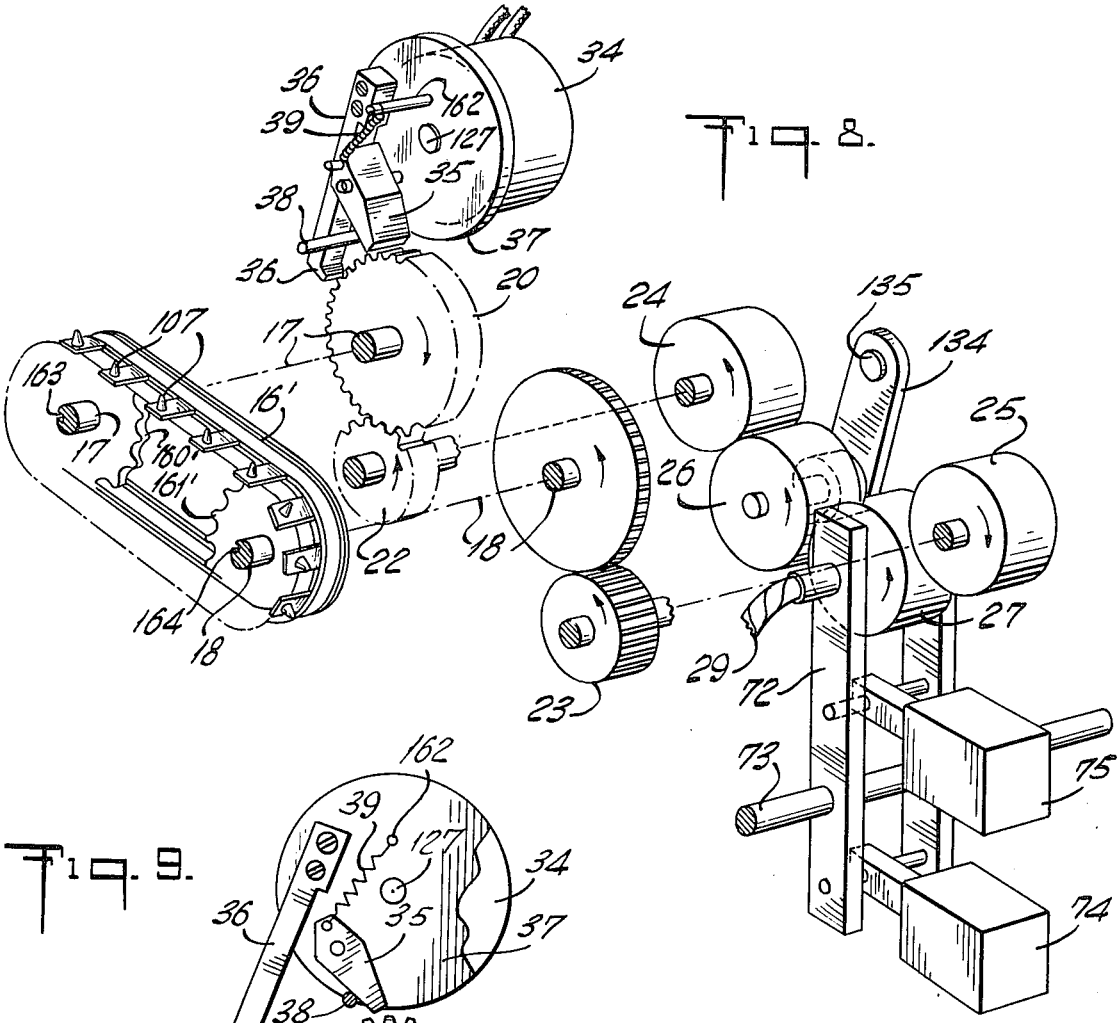
FIG. 8 is a fragmentary exploded perspective view illustrating the incremental forward feed mechanism and a forward and rearward quick return mechanism of the apparatus according to the invention.
Figure 9:
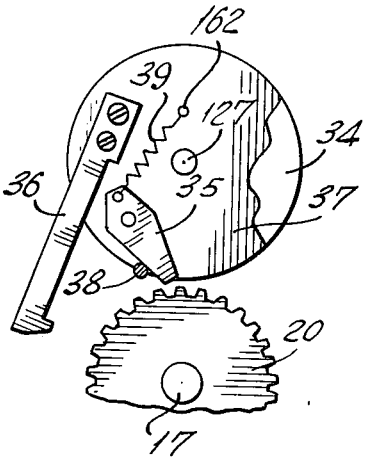
FIG. 9 is a fragmentary end view illustrating the incremental feed mechanism in a retracted position.
Figure 10:
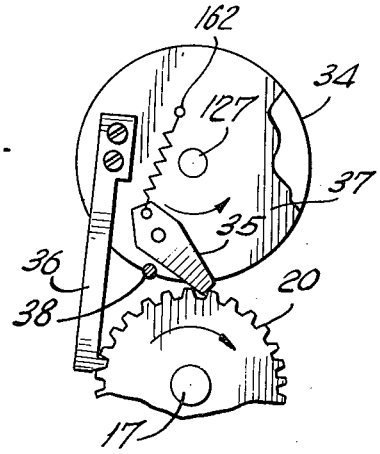
FIG. 10 illustrates the incremental forward feed mechanism of FIG. 9 in engaged position.

The step by step incremental feed of the paper during the printing of each character is accomplished by the mechanism as shown in detail in FIGS. 8, 9 and 10. Referring to the figures, there is shown one side of the paper track mechanism comprised of paper tractor 16 pivotably supported on sprocket wheels 160 and 161. Tractor drive shafts 17 and 18 provide rotation to sprocket wheels 160 and 161 to advance or return tractor 16 during the printing of the paper. Shaft 17 is keyed to gear 20 through shaft 17 and provides step by step advancement to the paper track in the following manner. A rotary solenoid 34 secured to the frame of the printer (as shown with respect to FIG. 2) includes a pawl mounting plate 37 coupled to its output drive shaft 127. A pawl 35 is mounted on plate 37 in close alignment with tractor drive gear 20. Plate 37 also includes stop arm 36 adapted to engage gear 20 when plate 37 is rotated. Both pawl 35 and stop arm 36 are normally out of engagement with gear 20 when solenoid 34 is not energized. A pawl tension spring 39 coupled to post 162 on pawl stop mounting plate 37, maintaining pawl 35 against pawl alignment post 38 as shown in FIG. 9. When solnoid 34 is actuated (FIG. 10) pawl stop mounting plate 37 rotates clockwise around axis 127 to move pawl 35 into engagement with gear 20 to advance gear 20 which in turn advances track 16 a distance approximately equal to the width of one character. Stop mechanism 36 simultaneously engages gear 20 to prevent rotation of gear 20 beyond a single indexed character. After solenoid 34 has been de-energized, stop arm 36 and pawl 35 disengages from contact with gear 20 so as not to prevent the track mechanism from being rapidly advanced or returned to a new line of type.

B. INCREMENT SHIFT OF PAPER TRACTOR

Figure 16:
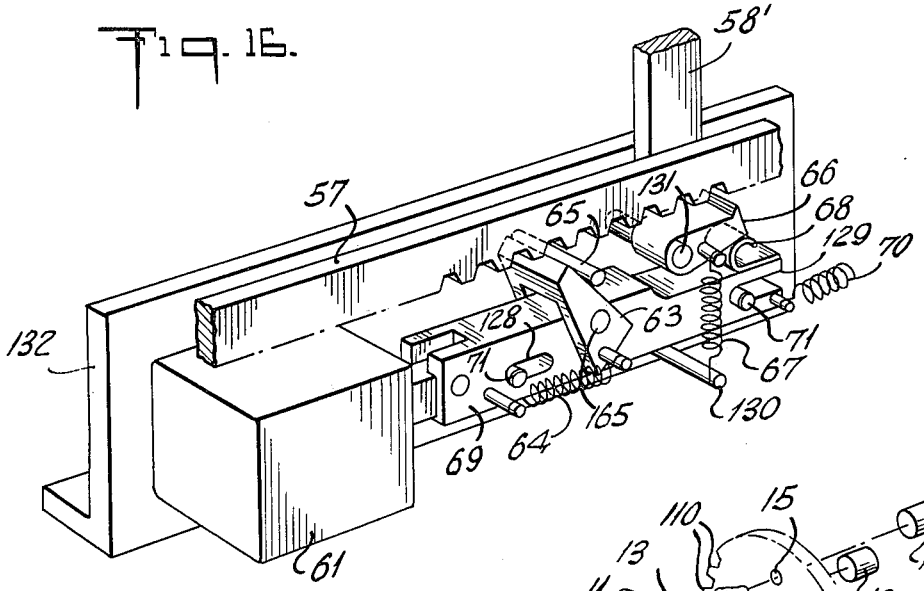
FIG. 16 is a front perspective view of the incremental shift feed mechanism illustrated in the apparatus of FIG. 5.

After a line of characters have been printed along one frame of paper 19 it is necessary to shift the paper one line so that the next succeeding line of characters will be printed below and parallel to the preceding line of characters. The paper tractors 16 and 16' have been described as being mounted on a carriage 108 supported by a pair of parallel drive shafts 17 and 18 each having a longitudinal keyway 163, 164 to permit the paper tractor to slide in either direction along the length of the drive shafts transverse to the movement of paper 19. Incremental control of the transverse movement of paper track 16 along the drive shaft is best illustrated with reference to FIGS. 5, 16 and 17. Referring to these figures, there is shown a solenoid type linear actuator 61 having an armature 62 coupled to a pawl and stop slide mount 69 for providing movement to a rack 57 disposed upon the slide mount. Rack 57 is supported by depending bars 58 and 58' which are integral with carriage 108 upon which tracks 16 and 16' are pivotably mounted. Thus movement of rack 57 provides a corresponding movement of carriage 108 and thus moves or shifts paper tractor 16 along the axis of drive shafts 17 and 18.

Figure 17:
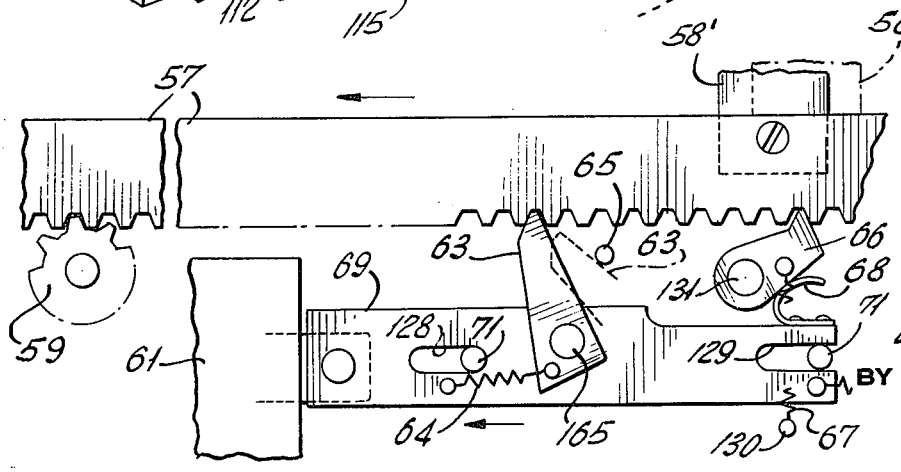
FIG. 17 is an enlarged fragmentary front view of the incremental shift feed mechanism of FIG. 16 showing the solenoid energized to produce a shift in the line of the printed characters.

On slide mount 69 a pawl 63 is pivotably mounted to rotate on axis 165. Pawl 63 is urged by spring 64 against a fixed guide pin 65 affixed to the chassis of the printer. Guide pin 65 maintains pawl 63 out of engagement with rack 57 until solenoid 61 is actuated. Rack 69 also includes a pair of longitudinal slots 128 and 129 in which are disposed fixed slide pins 71, secured to frame member 132. Pins 71 are adapted to slide within slot 128 to limit the travel of mount 69 during operation of actuator 61 by means of tension spring 70 having one end coupled to the slide mount and its opposite end, connected to the chassis. A further spring holding pin 130 secured to frame 132 contains a tension spring 67 coupled to a stop 66. Stop 66 is pivotably mounted on pin 131 secured to frame member 132 of the recording apparatus. A stop actuator spring 68 is shown mounted on slide mount 69 and in engagement with stop 66. When the actuator is de-energized, the actuator spring 68 engages only the end of the stop 66 so that stop 66 remains out of engagement with rack 57. When solenoid 61 is actuated, pawl 63 moves away from guide pin 65 as slide 69 moves toward solenoid 61. As shown in FIG. 17, spring 64 causes pawl 63 to pivot around axis 165 and into engagement with one of the slots of rack 57 to advance the rack. Slide mount 69 moves stop actuator spring 68 along the undersurface of stop 66 to raise stop 66 in engagement with one of the slots of rack 57 after pawl 63 has the track one line of type. The release of actuator 61 causes slide mount 69 to return to its unenergized state under the pull of spring 70. Pawl 63 then moves back into contact with pin 65 and stop spring 68 slides toward the end of stop 66. Both pawl 63 and stop 66 then become disengaged from the rack 57 when solenoid 61 is de-energized. A dash pot 133 (FIG. 2) is provided between gear 21 and its coupling to shaft 18 in order to absorb the shock and other stresses inherent in quick stop drive mechanisms.

C. QUICK SHIFT RETURN OF PAPER TRACTOR

Figure 5:
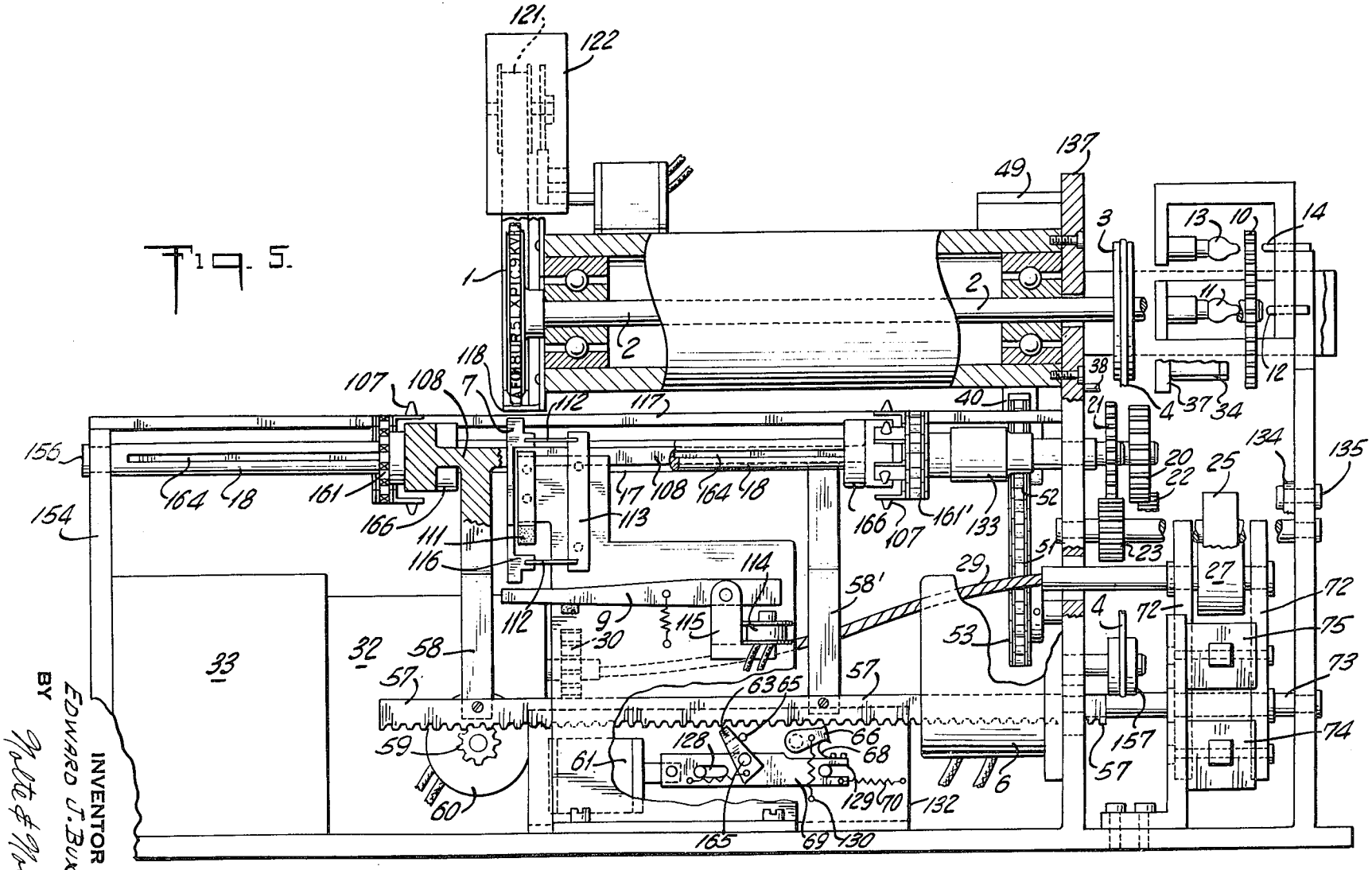
FIG. 5 is an rear view of FIG. 2 showing parts broken away and in section or detail.

After the last line of the printed message has been typed onto the paper frame, it is necessary to rapidly shift the carriage to the first line of type to facilitate the printing of the next frame of type. Referring to FIGS. 5 and 17, rack 57 is shown having one end coupled to pinion 59. Pinion 59 is coupled to disc type solenoid clutch 60 which when actuated couples pinion 59 to gear box 32. Gear box 32 is driven continuously by motor 33 during the operation of the printer.

Since the pawl 65 and stop 66 remain disengaged from rack 57 when actuator 61 is de-energized, actuation of clutch 60 will cause pinion 59 to rapidly shift rack 57 and thus paper track 16 along the axis of shafts 17 and 18 to the first line of printing. Track 16 is stopped when sprocket 161' strikes against dash pot 133.

D. QUICK FEED RETURN OF PAPER TRACTOR

Figure 3:
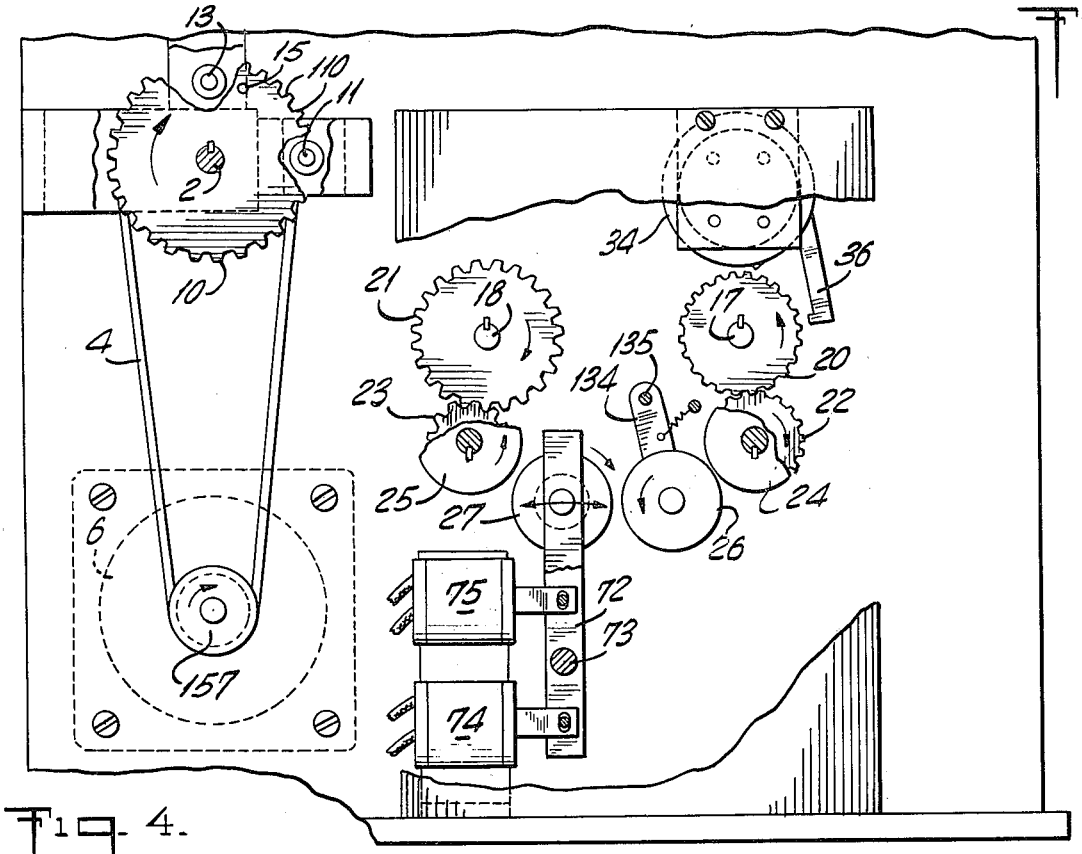
FIG. 3 is a fragmentary end view taken along section 3—3 of FIG. 2.

At the end of each line of type which is printed by the printing apparatus it is necessary to quickly return paper tractor 16 to its initial border position 104 so as to permit a new line of type to be added to the frame immediately below the succeeding line of type. As shown in FIGS. 2, 3 and 8 there are provided a pair of solenoids 74 and 75 having their actuating arms pivotably connected to cantilever section 72 on opposite sides of its pivot point 73. Preferably mounted on one extending end of cantilever section 72 is a master rubber drive wheel 27 driven by flexible shaft 29. The opposite end of shaft 29 is coupled to gear box 32 and drive motor 33 so that rubber wheel 27 rotates continuously. Cantilever section 72 may be pivoted so that wheel 27 will engage either idler wheel 26 or rubber wheel 25. When solenoids 74 and 75 are de-energized, rubber device wheel 27, however, remains out of contact with adjacent idler wheel 26 or rubber drive wheel 25.

In order to obtain a quick feed return of the paper mounted on paper tractor 16, solenoid 75 is actuated to move wheel 27 against rubber wheel 25 which is keyed to the same shaft as gear 23. Gear 23 is engaged with gear 21 secured to the end of shaft 18 to rotate paper track 16 back to its original position.

E. QUICK FORWARD FEED OF PAPER TRACTOR

After the last line on the frame of paper 19 has been printed, it becomes necessary to quickly advance the paper forward along the direction of arrow 152 to the margin of the next frame to continue the printing.

In order to obtain a quick forward feed of the paper mounted on paper tractor 16, solenoid 74 is energized so as to move continuously rotating rubber wheel 27 into engagement with idler wheel 26. idler wheel 26, supported by depending arm 134 and secured to the chassis of the printer by pivot 135, is urged by wheel 27 into engagement with rubber wheel 24. Gear 22 is keyed to the same shaft as rubber wheel 24 shown in engagement with gear 20. Gear 20 is coupled through shaft 17 to paper tractor 16 so that the rotation of rubber wheel 27 is transmitted to shaft 17 to move the paper tractor and rapidly advance the paper to the margin of the next frame to permit the printing of a new line of type.

For both the quick forward and the quick return directions, it is necessary to accurately limit the amount of travel of paper tractor 16 so that the paper is advanced or returned a distance sufficient to permit its margin to stop immediately below character wheel 1.

To assure that the paper tractor 16 returns the paper back to the margin and proceeds no further, a separate stop mechanism is provided coupled to shaft 17 for limiting the travel of the tractor. Referring to FIGS. 11, 12, 13, 14 and 15, there is coupled to shaft 17 a sprocket 52 having an endless pawl chain 51 mounted therearound and coupled to the idler sprocket 53 rotatably mounted to the frame of the printer. Connected to one of the links of pawl chain 51 is a triangularly shaped pawl 40 projecting outwardly from the chain. Pawl 40 is free to rotate with pawl chain 51 around sprockets 52 and 53 in response to rotation of shaft 17. Adjacent to sprocket wheel 52 in close contact with the chain is supported a pair of opposing stops 45 and 51 pivotably and slideably mounted on pins 48 and 44 and adapted to engage pawl 40 during rotation of pawl chain 51. It is to be understood that different sizes of paper forms may be utilized by the simple expedient of changing the length of pawl chain 51.

Figure 11:
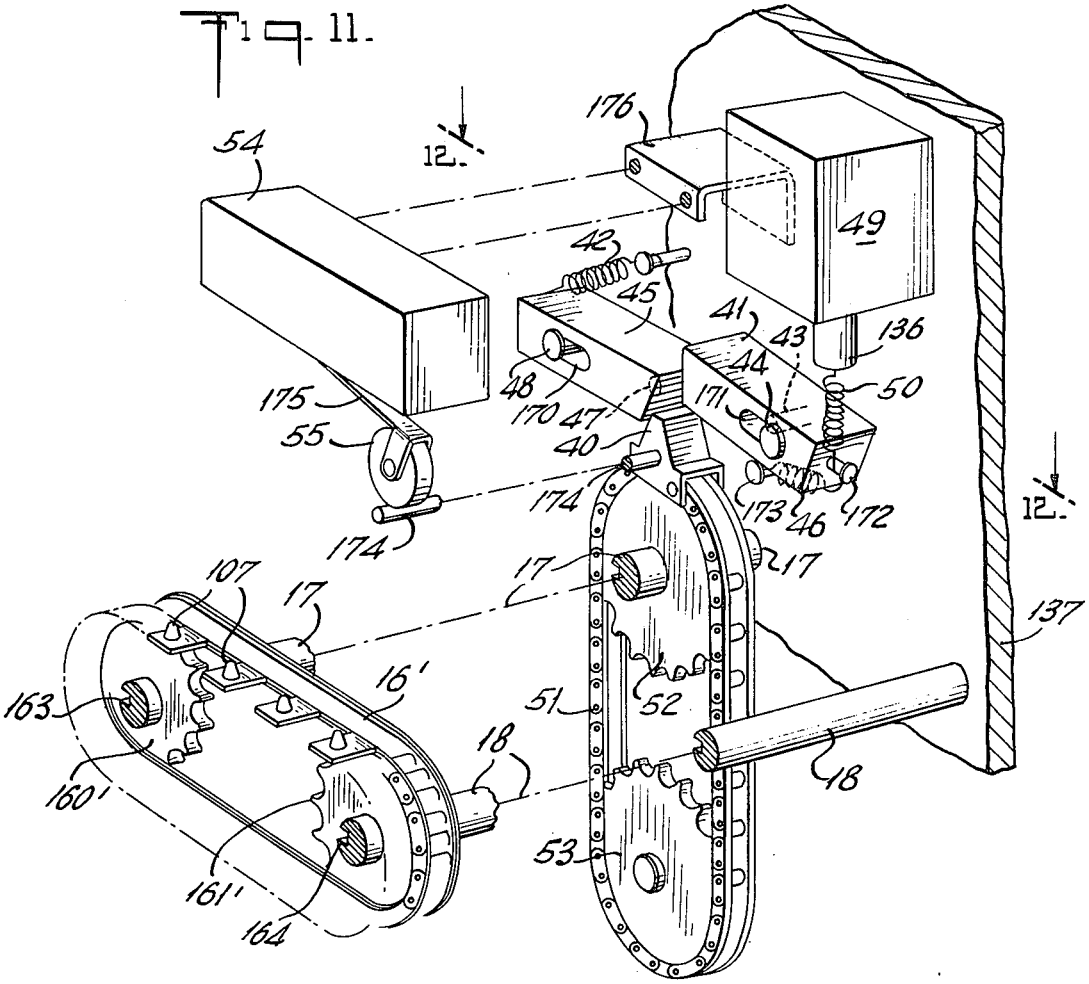
FIG. 11 is a fragmentary diagrammatic perspective view of the carriage return mechanism employed in the apparatus according to the invention.
Figure 12:
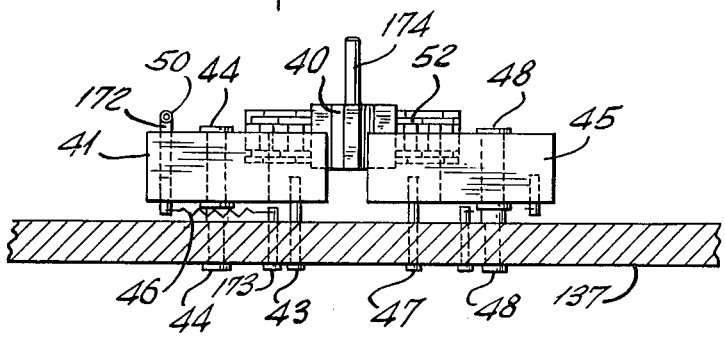
FIG. 12 is a fragmentary sectional view along lines 12—12 on FIGS. 4 and 11.
Figure 13:
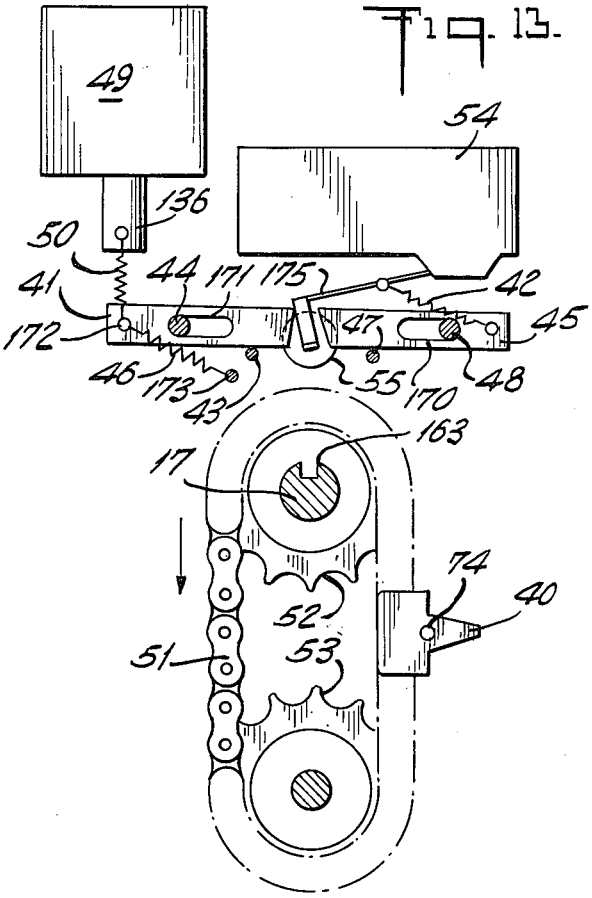
FIG. 13 is a fragmentary sectional view of a portion of FIG. 4 illustrating the position of the carriage return apparatus when the paper is approximately at the end of a line of type.

As shown in FIG. 11, stop 45 includes a longitudinal slot 170 for receiving pin 48. Spring 42 urges stop 45 toward pawl 40 and against guide pin 47 secured to frame member 137. The contacting end of stop 45 contains a sloping edge adapted to engage the sloping triangular surface of pawl 40.

In a like manner, stop 41 includes a longitudinal slot 171 for receiving pin 44 secured to frame 137. Stop 41 contains a post 172 for receiving a spring 50 connected from plunger 136 of solenoid 49 and adapted to hold stop 41 in tension against guide pin 43. Post 172 also receives tension spring 46 coupled to pin 173 for counterbalancing the effect of spring 50 and for holding stop 41 from engagement with pawl 40 when solenoid 49 is de-energized. When solenoid 49 is energized, its corresponding plunger 136 pulls spring 50 so as to move stop 41 into the path of chain 51 for engagement with pawl 40.

Pawl 40 includes a pin 174 adapted to engage roller 55 on arm 175 to actuate snap action switch 54 when pawl 40 engages stops 41 or 45. Switch 54 is mounted to frame member 137 by means of U-shaped bracket 176 and when actuated, signals the printer that paper 19 is in position ready to be printed.

Figure 4:
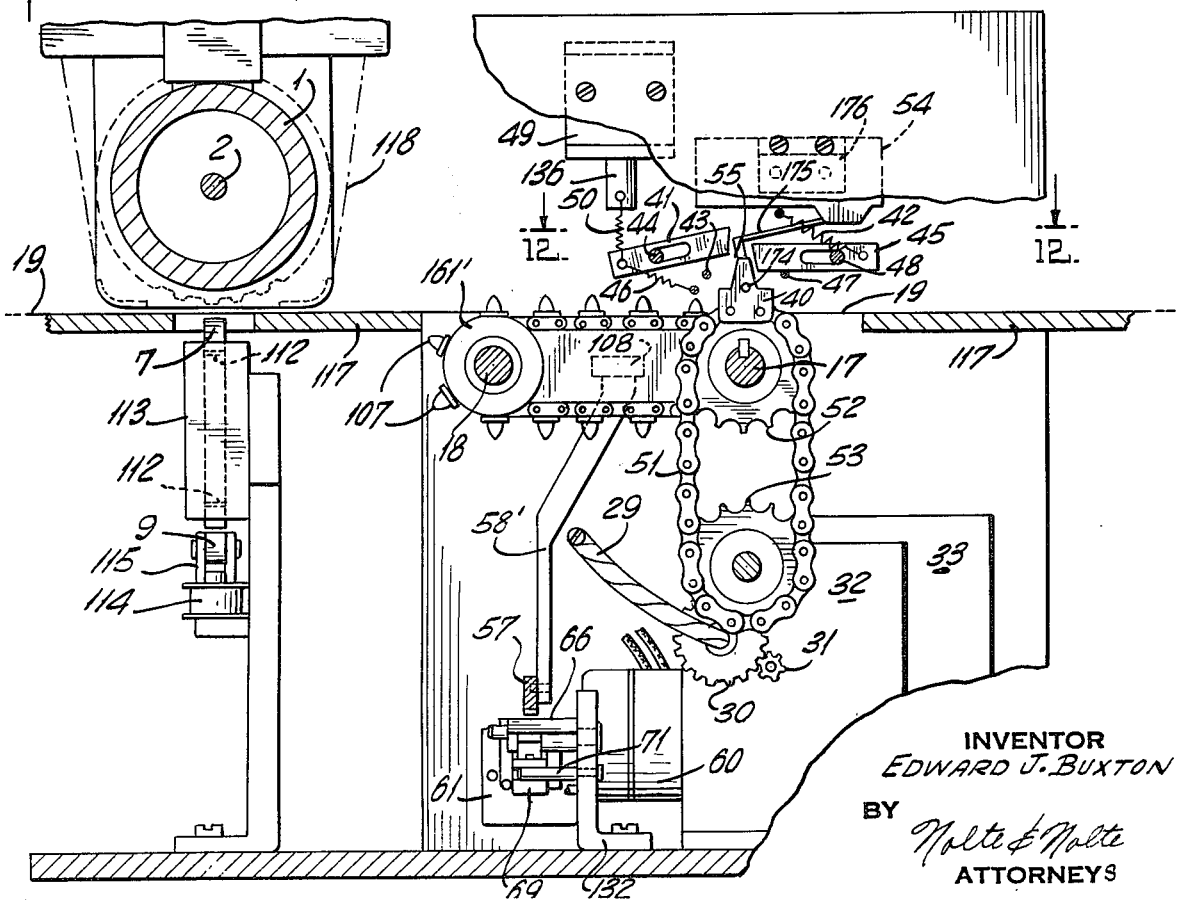
FIG. 4 is a fragmentary-end view of the apparatus according to the invention along section 4—4 of FIG. 2.
Figure 14:
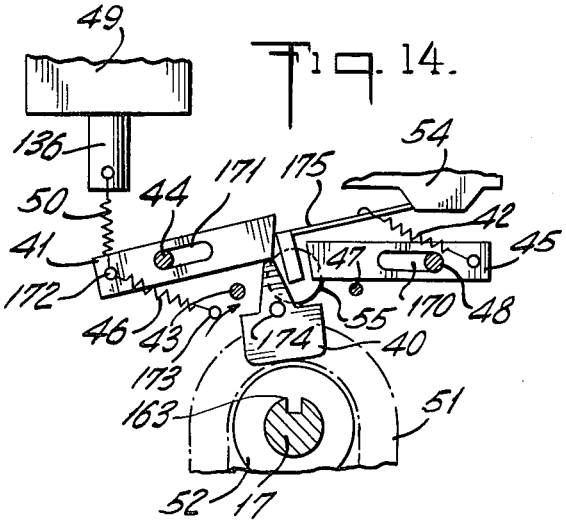
FIG. 14 illustrates the carriage return mechanism sliding into a position after the quick return of the carriage immediately before being secured between a pair of opposing stops.

When a new line of type is to be printed, solenoid 49 is de-energized so that stop 41 is raised out of engagement with pawl 40 to permit chain 51 to move pawl 40 counterclockwise around sprockets 52 and 53 (see FIG. 4). At the end of a line of type, pawl 40 has moved to the approximate position shown by FIG. 13. If paper 19 is to be returned to its original margin for a new line of type, solenoid 75 is actuated to apply clockwise rotation to chain 51 through shaft 17 to quickly return pawl 40 until it strikes stop 45. FIG. 14 illustrates the return of pawl 40 just prior to striking stop 45 whereby stop 41 is urged upward due to its momentary contact with pawl 40 to permit the pawl to engage stop 45.

Figure 15:
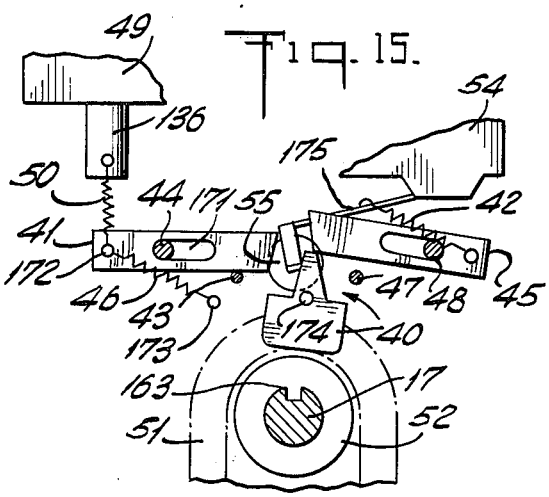
FIG. 15 illustrates the carriage return mechanism sliding into position from a quick forward position between a pair of opposing stops.

If on the other hand, paper 19 is to be advanced to a new margin on a succeeding frame, solenoid 74 is actuated to provide rapid counterclockwise rotation to pawl 40. Pawl 40 then advances further to complete the cycle of rotation of chain 51 until it strikes stop 41. FIG. 15 illustrates the advance of pawl 40 just prior to striking stop 41 whereby stop 45 is urged upward by its contact with the top surface of pawl 40 as the pawl moves into postion for engagement with stop 41. Pawl 40 then actuates snap switch 54 to permit a new line of characters to be printed.

Figure 19:
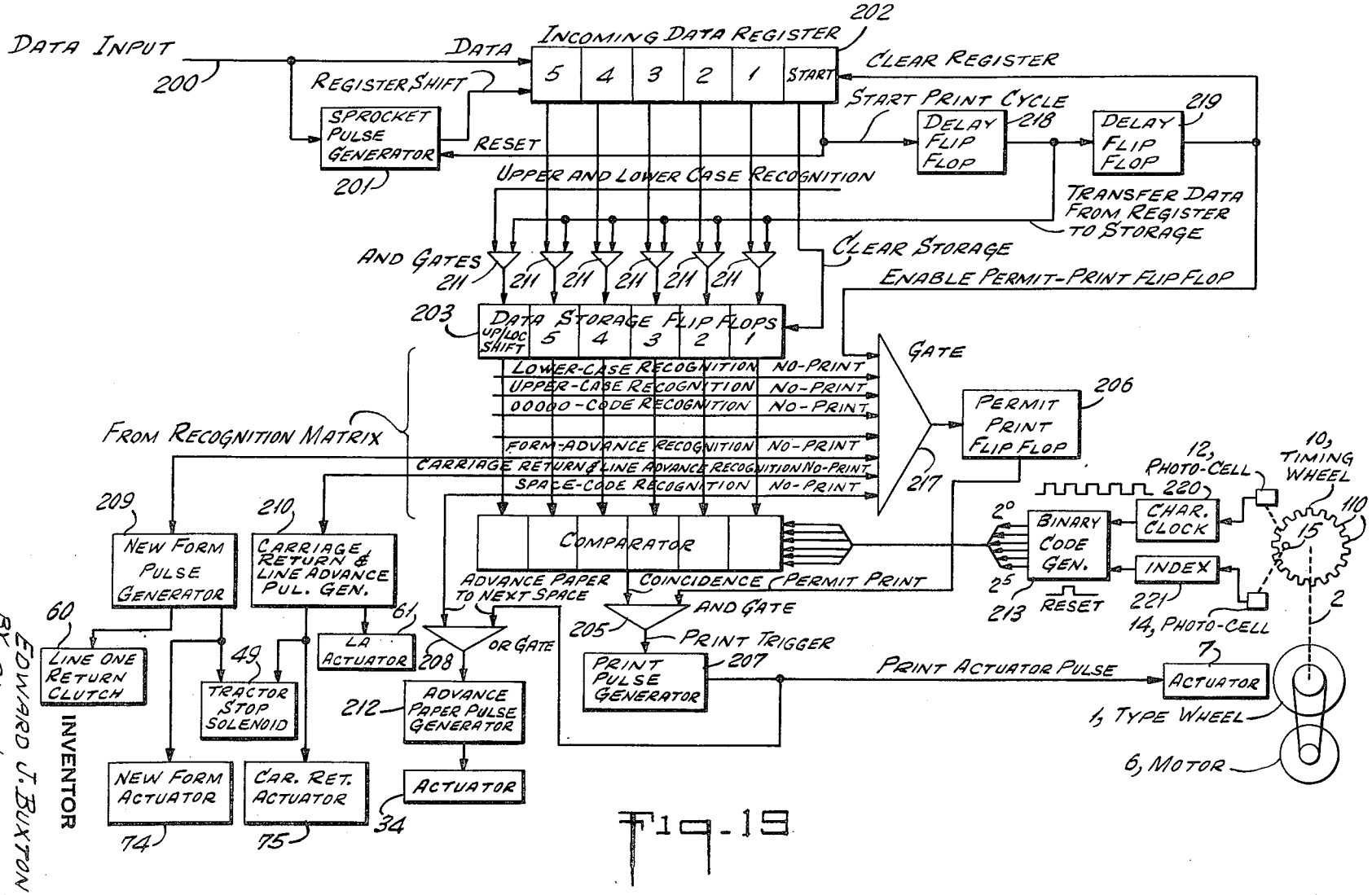
FIG. 19 is a schematic diagram of the electronic circuitry for converting a digital information code into a signal sufficient to actuate the printing apparatus according to the invention responsive to the coded message input.

FIG. 19 discloses the electronic circuitry required to actuate and operate the printer according to the invention. The incoming data is applied to input line 200 and consists of a five-bit digital code representing each of the characters to be printed. A sprocket pulse generator 201 is provided to shift incoming data register 202 to correspond to the incoming data applied. The input digital word is preceded by a start signal pulse which is stored in one of the bins of incoming data register 202. This signal triggers a delay flip flop to produce the transfer data from register to storage signal which is coupled to AND gates 211.

The start pulse is also coupled to a second delay flip flop 219 to generate a clear register signal, which is sent back to incoming data register 202 to clear the register so that the next binary word can be stored in incoming data register 202. The output of register 202 is coupled through AND gates 211 to units 1–5 of data storage flip flops 203 where they are stored and coupled to comparator 204 wherein they are compared with binary-coded character identification signals supplied by binary code generator 213. Photo cell 12 translates character position represented by the teeth 222 on constantly-rotating timing wheel 10 into discrete time-referenced clock pulses which are applied to the binary-code generator 213. Photo cell 14 translates the beginning of the character group sequence represented by reference hole 15 in timing wheel 10 into the time-referenced index pulse which is also applied to binary code generator 213.

A light source 11 is positioned with respect to photo cell 12 to impinge upon the photo cell. However, timing wheel 10 is so disposed to break the light transmission path between the light source and the photo cell each time a gear tooth interrupts the light path.

A second lamp source 13 is made to fall on an index photo cell 14 each time the reference hole 15 passes therebetween, thus producing one pulse at photocell 14 for each revolution of time wheel 10. The character pulses from photo cell 12 and the reference pulse from photo cell 14 are coupled respectively to multivibrators 220 and 211. The outputs of multivibrators 220 and 221 are fed to the binary word generator 213 which counts the number of character pulses from multivibrator 220, but is reset to zero each time it receives a reference pulse from multivibrator 221. Consequently the output of binary word generator 213 provides, in binary form, an indication of the position of the type or character wheel 1. Whenever the generated binary code coincides with the data code, the comparator emits and delivers a coincidence pulse to AND gate 205. In all instances when a permit print signal is simultaneously applied with the coincidence signal to AND gate 205 a print trigger signal is delivered from AND gate 205 to print pulse generator 207 which generates a print actuator pulse. The print actuator pulse energizes actuator 7 which impells a print hammer against constantly-rotating character wheel 1 to produce an imprint of the desired character on the paper form interposed between the hammer and an inked ribbon and the character wheel. In addition, OR gate 208 receives a signal from print pulse generator 207 to trigger advance-paper pulse generator 212. Generator 212 then delivers a pulse to actuator 34 to advance the paper one step for the printing of the next character, as previously described.

Incoming data 200 contains codes which represent machine functions other than printing. Whenever these codes are provided it is necessary to recognize these codes and generate the required signals for actuating the functions while at the same time preventing the codes from initiating print action. For this purpose a recognition matrix (not shown) is provided wherein a plurality of diode lines serve to recognize the individual function codes stored by data-storage flip flops 203. For each function a signal is supplied by the recognition matrix to gate 271 which prevents the passage of the enable-permit-print-flip-flop signal when any of the no-print signals are present.

When an output pulse appears at gate 217, the permit print flip flop 206 is triggered thereby producing a permit print signal. Consequently, when a no-print signal is present at the input to gate 217, permit-print flip flop 206 does not supply the permit print signal to AND gate 205 and thus a coincidence signal input to gate 205 does not produce a print trigger at the output of AND gate 205, since both the permit print signal and the coincidence must simultaneously appear at the input of gate 205 for a print trigger to be generated. As a result, no printing occurs at a time that any function producing a no-print signal is present.

Such no-print functions include a space code signal to produce a space between the printed characters, a form advance signal, a carriage return, a line advance signal and an upper and lower case signal. In order to enable the use of a greater number of characters on type wheel 1, while still operating within a five-bit code, a lower or case signal is produced by binary code generator 213 which is determined by which half of the wheel circumference is rotating in the line of the photo cell 12. The dividing point for these two halves, which are defined as the lower and upper case characters, is the position of reference hole 15 in timing wheel 10. As timing wheel 10 is connected to type wheel 1, by a shaft, there is a direct correspondence of the position of both wheels.

The upper and lower case recognition signal is stored in data register 203, as shown in FIG. 19, and is compared, along with five character bits, with the signal produced by the binary code generator 213 by comparator 204.

After a line of printing has been completed, pulse generator 210 is actuated by a function signal from the recognition matrix to produce a signal at its output to simultaneously operate quick return feed solenoid 75 and line advance solenoid 61 so that paper 19 is automatically returned to the margin and advanced one line of type.

After one frame of paper 19 has been completely printed, pulse generator 209 is actuated by a function signal from the recognition matrix to produce a signal at its output for energizing actuator 74 to rapidly advance the paper tractor so as to move the margin of a new frame of paper in place for printing. Moreover, clutch 60 is simultaneously engaged to move the paper tractor transversely with respect to the feed of the paper so as to position the paper with respect to the charactor wheel to permit the first line of the new form to be printed.

In each instance that pulse generators 209 and 210 supply signals to cause the carriage-return or the advance-to-new-form functions, a signal is supplied to solenoid 49 to move tractor stop mechanism 41 into position to engage it with pawl 40 and stop the paper tractor 16 at the margin. After a fixed interval of time the signal is removed from solenoid 49 permitting stop 41 to move away from and clear pawl 40 by means of spring tension and thus allow free movement of the paper tractor.

What is claimed is:

1. A high speed printing apparatus for printing a plurality of indicia onto a paper in response to a coded message, comprising a continuously rotating character wheel mounted at a fixed location within said apparatus and having a plurality of characters disposed along its periphery; a paper tractor for supporting and positioning said paper in close proximity to said character wheel, said paper tractor comprising at least one endless belt drive means having a plurality of evenly spaced sprocket pins disposed along its periphery adapted to engage said paper, a pair of spaced drive shafts rotatably mounted transversely to said belt drive means, and a carriage for supporting said belt drive means, said carriage being slidably coupled to said pair of spaced transverse drive shafts and said shafts being coupled to said belt drive means for providing rotation thereto; incremental feed means for successively indexing said tractor the length of one character space, said incremental feed means comprising a gear secured to one of said tractor drive shafts and means for advancing said gear to thereby advance said tractor the length of one character space; printing means including means for momentarily striking said paper toward said character wheel to effect printing engagement with one of said characters to print a corresponding indicia on said paper in response to said coded message when said paper is indexed; incremental shift means for moving said tractor transversely to the direction of said paper indexing to a position corresponding to the next line after a plurality of indicia have been printed, said incremental shift means comprising a rack secured to said carriage and a solenoid operatively connected to said rack for moving said rack and thereby said carriage the length of one line of type; and quick return means coupled to said paper tractor for positioning the margin of said paper in close proximity to said character wheel when said incremental shift means is actuated.

2. The apparatus as recited in claim 1, wherein said feed means comprises a gear secured to one of said tractor drive shafts, a pawl disposed adjacent to the periphery of said gear and a rotary solenoid for moving said pawl into engagement with said gear to advance said tractor the length of one character space.

3. A high speed printing apparatus for printing a plurality of indicia onto a continuous paper in response to a coded message, comprising a continuously rotating character wheel mounted at a fixed location within said apparatus and having a plurality of characters disposed along its periphery; a paper tractor for supporting and positioning said paper in close proximity to said character wheel, said paper tractor comprising at least one endless belt drive means having a plurality of evenly spaced sprocket pins disposed along its periphery adapted to engage said paper, a pair of spaced drive shafts rotatably mounted transversely to said belt drive means, and a carriage for supporting said belt drive means, said carriage being slidably coupled to said pair of spaced transverse drive shafts and said shafts being coupled to said belt drive means for providing rotation thereto; incremental feed means for successively indexing said tractor the length of one character space, said incremental feed means comprising a gear secured to one of said tractor drive shafts, a pawl disposed adjacent to the periphery of said gear, and a rotary solenoid for moving said pawl into engagement with said gear to advance said tractor the length of one character space; printing means including means for momentarily striking said paper toward said character wheel to effect printing engagement with one of said characters to print a corresponding indicia on said paper in response to said coded message when said paper is indexed; incremental shift means for moving said tractor transversely to the direction of said paper indexing to a position corresponding to the next line after a plurality of indicia have been printed, said incremental shift means comprising a rack secured to said carriage and having a plurality of evenly spaced slots, a slide mount having a pawl pivotally mounted thereon and held adjacent to one of said slots, and a solenoid coupled to said slide mount for moving said slide mount and urging said last-mentioned pawl into one of said slots so that said last-mentioned pawl, said rack and said carriage shift in response to the motion of said slide mount the length of one line of type; and quick return means coupled to said paper tractor for positioning the margin of said paper in close proximity to said character wheel when said incremental shift means is actuated.

4. The apparatus as recited in claim 3, additionally comprising quick forward feed means coupled to said tractor for advancing the paper to a new margin area for the printing of a new line of type when the printing of said last line of type has been completed.

5. The apparatus as recited in claim 4, and additionally comprising quick shift return means for shifting said tractor to said first line of type responsive to said forward feed means, and wherein said quick shift return means comprises a pinion coupled to said rack and means for applying rotation to said pinion when responsive to said forward return means.

6. The apparatus as recited in claim 4, wherein said quick forward feed means comprises a continuously rotating drive wheel, means for coupling said drive sheel into engagement with one of said tractor drive shafts when said paper is to be advanced to a new margin area for the printing of a new line of type.

7. A high speed printing apparatus for printing a plurality of indicia onto a paper in response to a coded message, comprising a continuously rotating character wheel mounted at a fixed location within said apparatus and having a plurality of characters disposed along its periphery; a paper tractor for supporting and positioning said paper in close proximity to said character wheel, said paper tractor comprising at least one endless belt drive means having a plurality of evenly spaced sprocket pins disposed along its periphery adapted to engage said paper, a pair of spaced drive shafts rotatably mounted transversely to said belt drive means, and a carriage for supporting said belt drive means, said carriage being slidably coupled to said pair of spaced transverse drive shafts and said shafts being coupled to said belt drive means for providing rotation thereto; incremental feed means for successively indexing said tractor the length of one character space, said incremental feed means comprising a gear secured to one of said tractor drive shafts and means for advancing said gear to thereby advance said tractor the length of one character space; printing means including means for momentarily striking said paper toward said character wheel to effect printing engagement with one of said characters to print a corresponding indicia on said paper in response to said coded message when said paper is indexed; incremental shift means for moving said tractor transversely to the direction of said paper indexing to a position corresponding to the next line after a plurality of indicia have been printed, said incremental shift means comprising a rack secured to said carriage and a solenoid operatively connected to said rack for moving said rack and thereby said carriage the length of one line of type; and quick return means coupled to said paper tractor for positioning the margin of said paper in close proximity of said character wheel when said incremental shift means is actuated, storage register means for said message, a comparator circuit, means for transferring said message from said storage register means to said comparator, means for converting the rotational position of said character wheel into a series of pulses proportional to said rotation, means for producing a binary word from said series of pulses, means for feeding said binary word into said comparator circuit whereby when said binary word and said message are identical a coincidence pulse is produced by said comparator circuit, hammer means placed perpendicular to said recording medium and said character wheel and actuator means for momentarily striking said hammer means against said record medium and said character wheel, said actuator means being responsive to said coincidence pulse, said converting means comprising a photo cell, a light source directed to impinge on said photo cell, gear means connected to said character wheel, gear means corresponding to each character on said character wheel, said wheel being so disposed that the teeth of said gear means interrupt the path between said light source and said photo cell, and a flip flop responsive to the output of said photo cell.

8. A high speed printing apparatus for printing a plurality of indicia onto a paper in response to a coded message, comprising a continuously rotating character wheel mounted at a fixed location within said apparatus and having a plurality of characters disposed along its periphery; a paper tractor for supporting and positioning said paper in close proximity to said character wheel, said paper tractor comprising at least one endless drive means having a plurality of evenly spaced sprocket pins disposed along its periphery adapted to engage said paper, a pair of spaced drive shafts rotatably mounted transversely to said belt drive means, and a carriage for supporting said belt drive means, said carriage being slidably coupled to said pair of spaced transverse drive shafts and said shafts being coupled to said belt drive means for providing rotation thereto; means for successively indexing in increments and advancing said tractor the length of one character space, printing means including means for momentarily striking said paper toward said character wheel to effect printing engagement with one of said characters to print a corresponding indicia on said paper in response to said coded message when said paper is indexed; incremental shaft means for moving said tractor transversely to the direction of said paper indexing to a position corresponding to the next line after a plurality of indicia have been printed, and quick return means coupled to said paper tractor for positioning the margin of said paper in close proximity to said character wheel when said incremental shift means is actuated.

9. A paper positioning mechanism for a printing apparatus comprising a pair of spaced drive shafts, a keyway in each of said shafts extending along the length thereof, a paper support member mounted on said drive shafts, a carriage journalled to said paper support member and adapted for shifting along said keyways, said printing apparatus being provided with a printing which is a signal character width, said paper support member including a pair of spaced sprocket wheels on each of said drive shafts secured to respective keyways to permit lateral movement of said paper support member along said drive shafts that is sufficient to permit any character position on the paper to be brought into alignment with said printing position, and escapement means for shifting said paper support member along said keyways.

10. A paper positioning mechanism comprising a pair of spaced drive shafts, a keyway in each of said shafts extending along the length thereof, a paper support member mounted on said drive shafts, a carriage journalled to said paper support member and adapted for shifting along said keyways, said paper support member including a pair of spaced sprocket wheels on each of said drive shafts slidably secured to respective keyways to permit lateral movement thereof, and escapement means for shifting said paper support member along said keyways, said escapement means comprising a movable rack operatively connected to said carriage, a pawl engaging said rack, a sliding member mounting said pawl, and means for moving said sliding member to thereby move said rack.

11. A high speed printing apparatus as recited in claim 7, further comprising a binary code generator receiving the pulses generated by said flip flop to produce a binary word corresponding to the number of said pulses.

12. An indicia impressing apparatus operable on an elongated paper strip having parallel first and second sides moving in a first direction parallel to said sides through said apparatus and having a plurality of frames separable from one another along lines extending across the paper strip in a second direction substantially perpendicular to said first direction from said first side to said second side, said apparatus comprising an indicia impressing device mounted at a fixed location within said apparatus, a paper tractor for supporting and sequentially positioning each one of said separable frames proximate to said indicia impressing device whereby indicia can be selectively impressed upon each one of said paper frames, incremental shift means for shifting each one of said frames incrementally along a line in said first direction in response to successive actuation of said indicia impressing device whereby indicia can be impressed in rows on said frames substantially parallel to the sides of said paper strip from a predetermined first margin to a predetermined second margin thereof, means for shifting each one of said paper frames incrementally in said second direction after said paper frame has been impressed with a row of indicia extending to said second margin, return means coupled to said paper tractor for returning each one of said paper frames non-incrementally in a third direction opposite to said first direction to said first margin from said second margin, shifting means for shifting the paper strip in said first direction non-incrementally from the second margin of said one frame to the first margin of the next following separable paper frame after said indicia impressing device has completed its indicia impressions on a number of rows on said one separable frame, and return means for returning the paper in a fourth direction opposite to said second direction non-indrementally to the first row of print at said first margin of said next following separable paper frame.

13. An indicia impressing apparatus as claimed in claim 12 wherein said paper is provided with sprocket holes at opposite sides thereof, and said paper tractor is a sprocket mechanism for engaging said sprocket holes to thereby move said elongated paper strip in said first direction.

14. An indicia impressing apparatus as claimed in claim 12 wherein said indicia impressing device is a continuously rotating wheel having a plurality of characters disposed along its periphery adjacent to said paper strip, said paper tractor being a carriage for moving said paper strip relative to said rotating wheel whereby the paper strip is printed in frames constituting said number of lines on each separable section.

15. Apparatus operable on an elongated paper strip, having parallel first and second sides, moving in a first direction through said apparatus having a plurality of frames separable from one another along lines extending across the paper strip in a second direction substantially perpendicular to said first direction from said first to said second side, comprising, paper tractor means for supporting said paper strip, incremental shift means coupled to said tractor means for shifting each one of said frames of the paper strip in said first direction so that indicia can be impressed along a line from a predetermined first margin to a predetermined second margin thereof, said margins being normal to the sides of said strip, means for shifting said one paper frame in second direction incrementally along a line from said one side to said second side of said elongated paper strip only after all incremental shifting of said paper frame between said first margin and said second margin along a given line between said first and second margins has been completed, return means coupled to said paper tractor for returning said one paper frame in a third direction opposite to said first direction to said first margin from said second margin, and shifting means for shifting the paper strip in said first direction from the second margin of said one frame to the first margin of the following separable paper frame, and return means for returning the paper strip in a fourth direction opposite to said second direction to said one side of said elongated paper strip, and means for selectively controlling said means for shifting said shifting means and said return means.

16. A paper transport for moving paper of the type having sprocket holes in a printing apparatus of the type having a fixed printing position, comprising a carriage, a pair of parallel spaced apart commonly driven shafts, a separate pair of paper driving sprocket wheels keyed on each shaft for rotation therewith and rotatably mounted on said carriage, said sprocket wheels being axially displaceable on said shafts and being positioned to engage the sprocket holes in said paper, means for selectively rotating said shafts about their axes, and means for selectively moving said carriage in opposite directions parallel to said shafts, said means for selectively rotating said shafts comprising a stepping mechanism connected to stepwise rotate said shafts in one direction, and means for rapidly rotating said shafts selectively in the direction opposite said one direction at a rate faster than the stepwise rotation thereof, stop means for inhibiting rotation of said shafts in either direction beyond predetermined angular displacements, said stop means comprising a pawl chain coupled to one of said shafts, pawl means on said chain, first and second fixed stops positioned to engage said pawl means at a given position of said chain to inhibit movement of said pawl in opposite respective directions, and control means for releasing said first stop, and means for selectively controlling said means for selectively moving, said means for selectively rotating, and said control means to control the movement of said paper.

17. The paper transport of claim 16 wherein said means for selectively moving said carriage in comprises ratchet stepping means coupled to said carriage to cause stepwise movement of said carriage in said one direction parallel to said shafts, and means coupled to said carriage for rapidly moving said carriage in said opposite direction parallel to said shafts.

18. In a printing apparatus having a relatively fixed printing positions and a carriage adapted to move in first and third relatively opposite directions and said carriage carries holding means for holding a sheet of imprintable material, the holding means comprising means for moving said sheet in second and fourth relatively opposite directions normal to said first and third directions, whereby said sheet may be selectively moved in said first, second, third and fourth directions past said printing position, and indicia impressing means at said printing position, and wherein means are provided for automatically moving the sheet in a given direction in a stepwise manner in response to sequential actuation of said indicia impressing means to form lines of printed indicia in the given direction on said sheet; the improvement wherein said means for automatically moving said sheet comprises means responsive to the sequential actuation of said indicia impressing means for automatically stepwise actuating said means for moving to move said sheet in said second direction, whereby said lines of indicia are formed in a direction parallel to said second and fourth directions.

19. The apparatus of claim 18 wherein said indicia impressing means comprises a rotatable printing wheel which carries on its circumference alphanumeric type the tops and bottoms of which extend parallel to said second and fourth directions.

20. The apparatus of claim 19 wherein said printing wheel has an axis of rotation parallel to said second and fourth directions.

21. In a printing apparatus of the type having a carriage for moving a sheet of imprintable material past a fixed printing station in first and third relatively opposite directions and said carriage includes rotary sheet material carrying means for moving the sheet material in second and foruth directions transverse to said first and third directions respectively past said printing station, the printing station being adapted to print alphanumeric indicia on said sheet material at positions aligned therewith; the improvement comprising means connected to said rotary means for incrementally rotating said rotary means to effect the incremental movement of said sheet material in said first direction between first and second margins on said sheet material, means coupled to said printing means and responsive to the movement of said sheet to said second margin for moving said carriage and increment in said second direction and for rotating said rotary means to effect a continuous movement of said sheet from said second margin to said first margin, and means responsive to the completion of a printing operation to effect the movement of said sheet in said fourth and first directions to align a different area of said sheet material with said printing position.

* * * * *